US010022977B2

(12) United States Patent
Mitsuo et al.

(10) Patent No.: US 10,022,977 B2
(45) Date of Patent: Jul. 17, 2018

(54) GEAR PUMP AND IMAGE RECORDING APPARATUS

(71) Applicant: SEIKO EPSON CORPORATION, Tokyo (JP)

(72) Inventors: Noritaka Mitsuo, Matsumoto (JP); Masaaki Ando, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 15/121,737

(22) PCT Filed: Feb. 24, 2015

(86) PCT No.: PCT/JP2015/000935
§ 371 (c)(1),
(2) Date: Aug. 25, 2016

(87) PCT Pub. No.: WO2015/129256
PCT Pub. Date: Sep. 3, 2015

(65) Prior Publication Data

US 2017/0015106 A1 Jan. 19, 2017

(30) Foreign Application Priority Data

Feb. 25, 2014 (JP) ..... 2014-033668

(51) Int. Cl.
*B41J 2/175* (2006.01)
*F04C 2/18* (2006.01)
(Continued)

(52) U.S. Cl.
CPC ..... *B41J 2/17596* (2013.01); *B41J 2/175* (2013.01); *B41J 2/18* (2013.01); *B41J 29/38* (2013.01);
(Continued)

(58) Field of Classification Search
CPC . B41J 2/17596; B41J 29/38; B41J 2/18; B41J 2/175; F04C 2/08; F04C 2/18;
(Continued)

(56) References Cited

U.S. PATENT DOCUMENTS 2,965,040 A * 12/1960 Eisenberg ..... F04C 2/18 418/102
2005/0276527 A1 12/2005 Yoo et al.
(Continued)

FOREIGN PATENT DOCUMENTS

JP 2005-354895 * 6/2005 ..... H02K 7/08
JP 2005-354895 12/2005
(Continued)

OTHER PUBLICATIONS

ISR and Written Opinion dated May 25, 2015 for PCT/JP2015/000935.

*Primary Examiner* — Geoffrey Mruk
(74) *Attorney, Agent, or Firm* — Workman Nydegger

(57) ABSTRACT

To reduce frictional heat generated between a rotation shaft and a bearing portion in a gear pump in which the rotation shaft having a gear mounted thereon is received by the bearing portion and an image recording apparatus having the gear pump. Provided is a gear pump which has a rotation shaft, a bearing portion which receives the rotation shaft, and a gear which is mounted on the rotation shaft and rotates with the rotation shaft, in such a manner that the gear feeds liquid. Furthermore, at least either a concave portion or a convex portion is provided in at least either the rotation shaft or the bearing portion.

16 Claims, 5 Drawing Sheets

(51) Int. Cl.

| | |
|---|---|
| ***B41J 2/18*** | (2006.01) |
| ***B41J 29/38*** | (2006.01) |
| ***F04C 2/08*** | (2006.01) |
| *F04C 15/00* | (2006.01) |

(52) U.S. Cl.
CPC ..... *F04C 2/08* (2013.01); *F04C 2/18* (2013.01); *F04C 15/0069* (2013.01); *F04C 2210/205* (2013.01); *F04C 2240/50* (2013.01); *F04C 2240/54* (2013.01); *F04C 2240/60* (2013.01)

(58) Field of Classification Search
CPC ..... F04C 2240/50; F04C 2240/60; F04C 2210/205; F04C 15/0069; F04C 2240/54
See application file for complete search history.

(56) References Cited

U.S. PATENT DOCUMENTS

2009/0311120 A1* 12/2009 Okada ..... F04C 2/18 418/73
2014/0285587 A1* 9/2014 Kida ..... B41J 2/17596 347/85

FOREIGN PATENT DOCUMENTS

JP 2008-169942 A 7/2008
JP 2012-021516 2/2012

* cited by examiner

[Fig. 1]
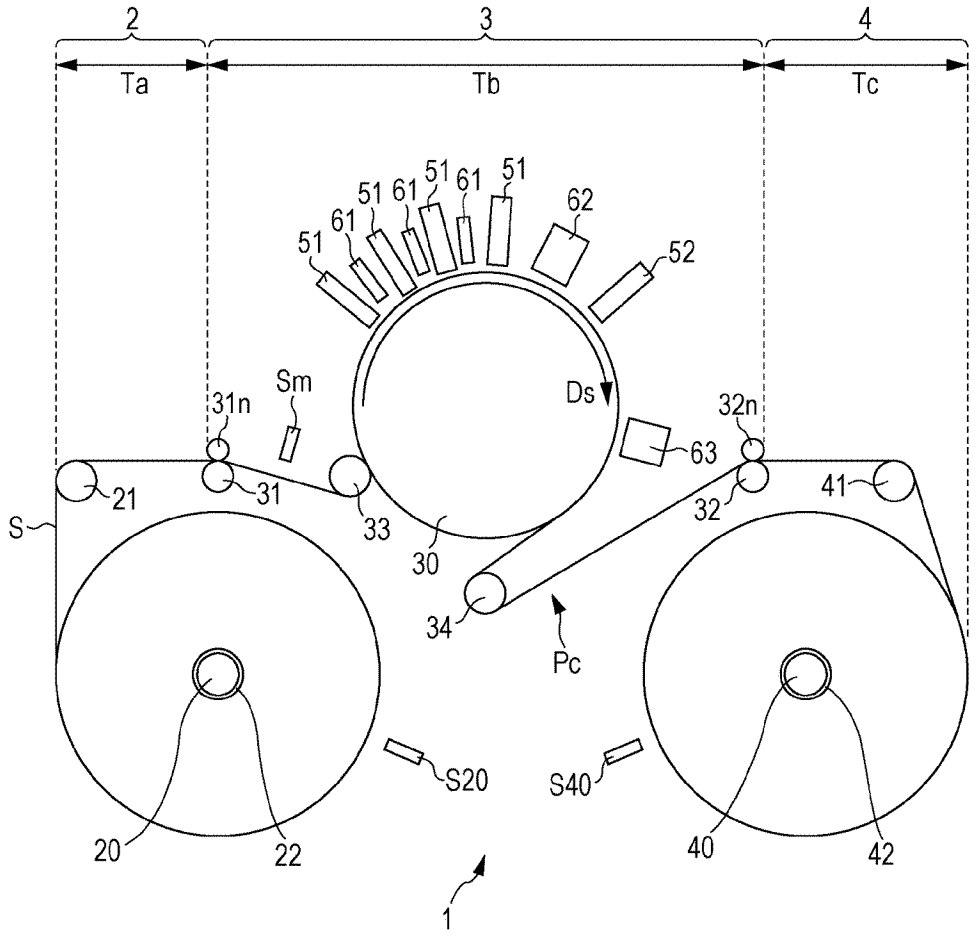

[Fig. 2]
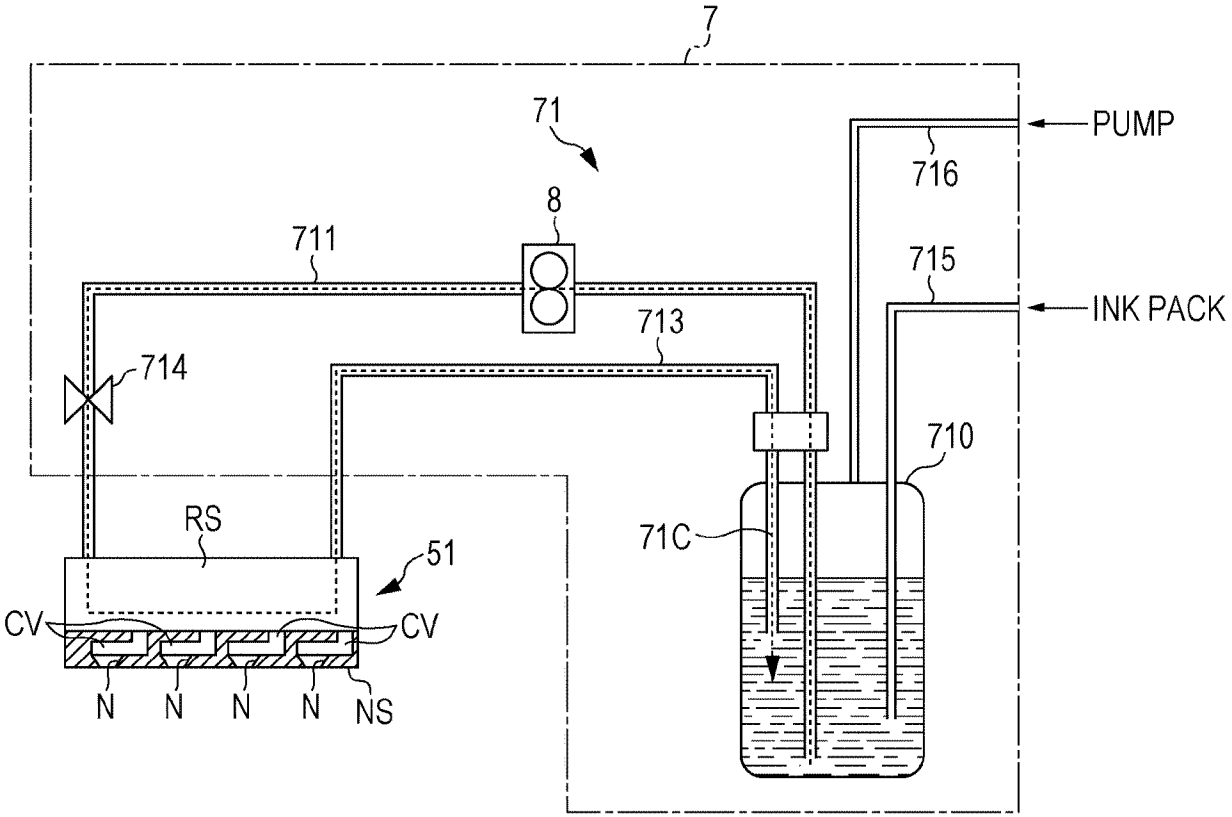

[Fig. 3]
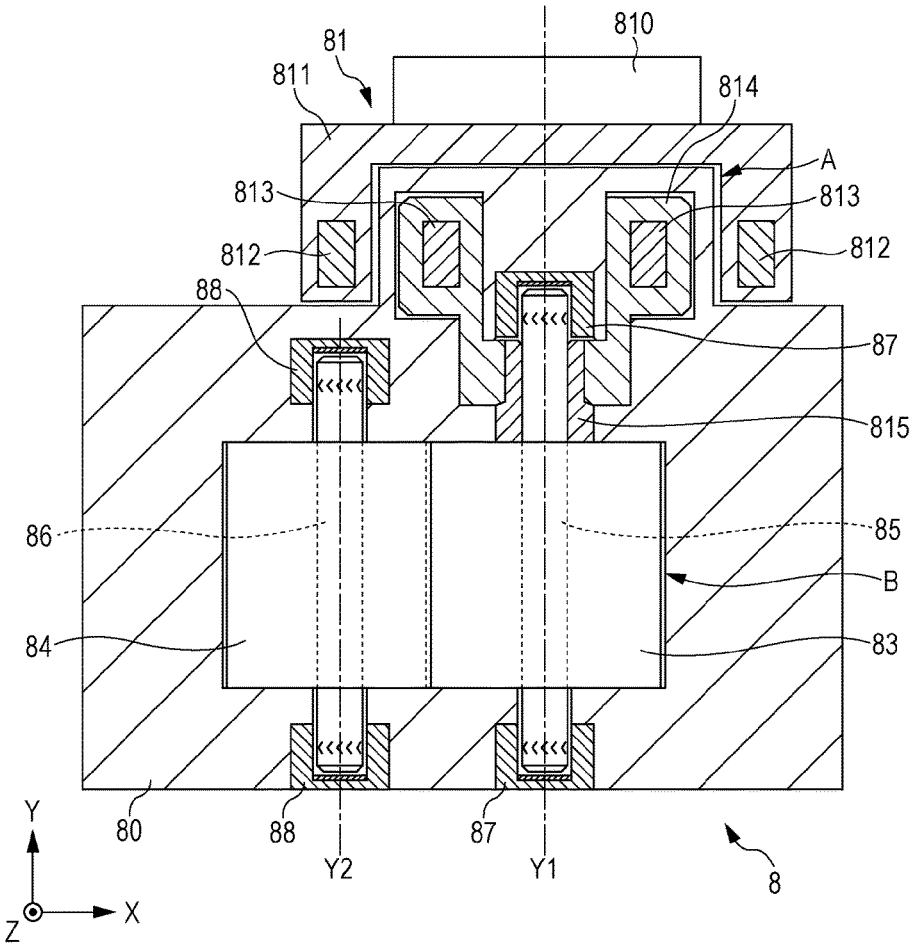

[Fig. 4]
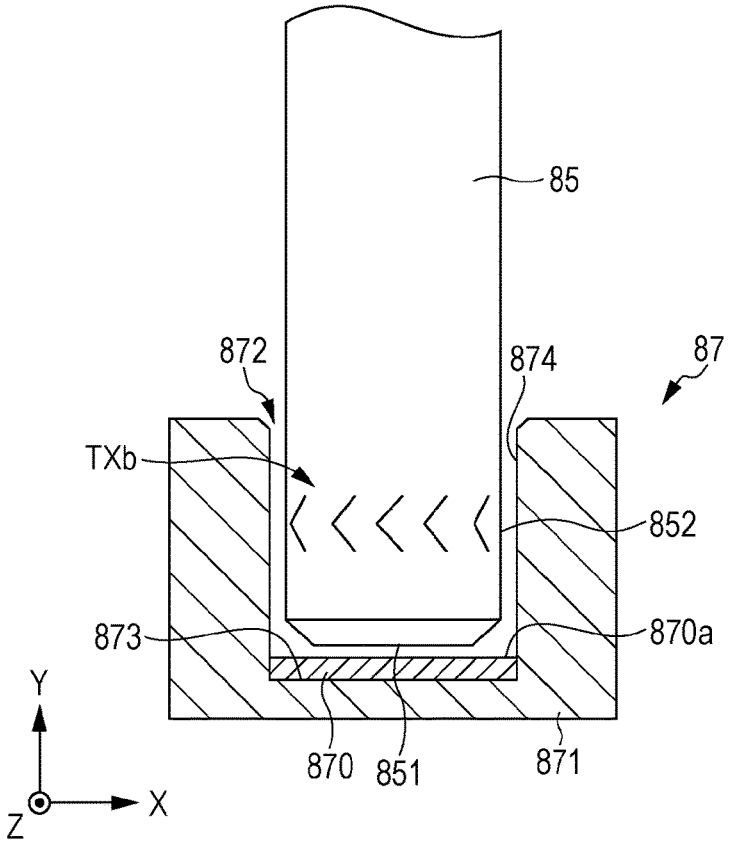

[Fig. 5A]
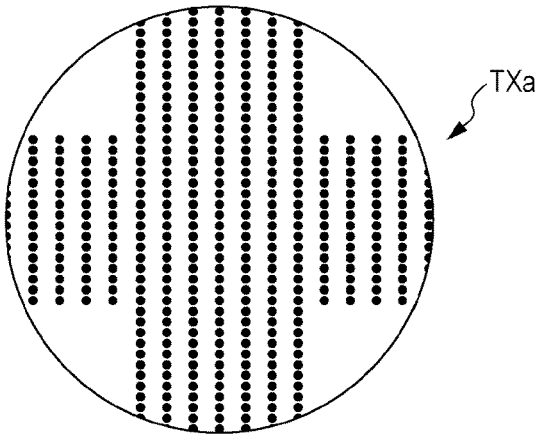
[Fig. 5B]
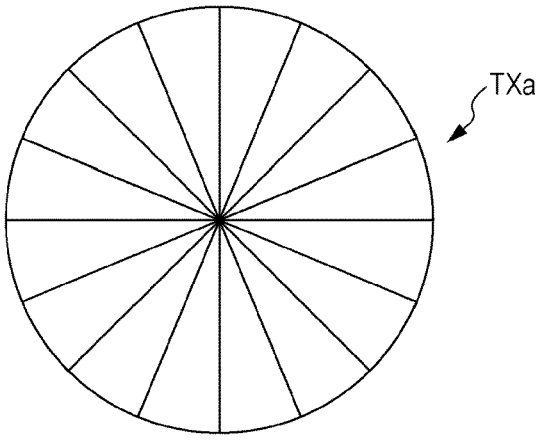
[Fig. 5C]
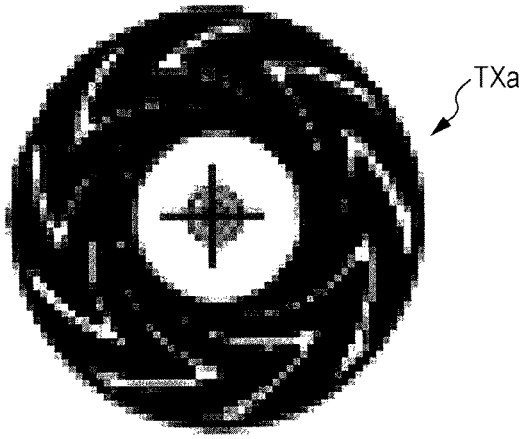

GEAR PUMP AND IMAGE RECORDING APPARATUS

TECHNICAL FIELD

The present invention relates to a gear pump in which a rotation shaft having a gear mounted thereon is received by a bearing portion and liquid is fed by rotating the gear and an image recording apparatus having the gear pump.

BACKGROUND ART

A gear pump in which ink used for printing is fed by rotating a gear is disclosed in PTL 1. The gear pump includes a rotation shaft having a gear mounted thereon and a bearing portion. In the gear pump, the rotating rotation shaft is received by a bearing.

CITATION LIST

Patent Literature

PTL 1: JP-A-2012-21516

SUMMARY OF INVENTION

Technical Problem

Meanwhile, when the rotation shaft rotates in a state where the rotation shaft and the bearing portion are in contact with each other, frictional heat is generated between the rotation shaft and the bearing portion. Therefore, in some cases, the quality of liquid, such as the ink described above, changes due to an increase in the temperature of the liquid, and thus the liquid is cured. Accordingly, the temperature of liquid in the vicinity of the bearing locally increases due to the frictional heat, and thus, in some cases, the heated liquid is cured and changed to foreign matter in the liquid. When the generated foreign matter enters a portion between the rotation shaft and the bearing portion, a problem such as a reduction in the rotation speed of the rotation shaft or stopping of the rotation, occurs. As a result, a technique capable of reducing frictional force generated between the rotation shaft and the bearing portion is needed.

The invention is made in view of the problem described above. An object of the invention is to provide a technique enabling frictional heat generated between a rotation shaft and a bearing portion to be reduced in a gear pump in which the rotation shaft having a gear mounted thereon is received by the bearing portion and an image recording apparatus having the gear pump.

Solution to Problem

To achieve the object described above, according to an aspect of the invention, there is provided a gear pump which includes a rotation shaft, a bearing portion which receives the rotation shaft, and a gear which is mounted on the rotation shaft and rotates with the rotation shaft, in such a manner that the gear feeds liquid. Furthermore, at least either a concave portion or a convex portion is provided in at least either the rotation shaft or the bearing portion. When the rotation shaft rotates, at least either the concave portion or the convex portion causes a dynamic pressure to be generated in liquid in a portion between the rotation shaft and the bearing portion, and thus the rotation shaft and the bearing portion move away from each other due to the dynamic pressure.

To achieve the object described above, according to another aspect of the invention, there is provided an image recording apparatus which includes a discharge portion which discharges liquid onto a recording medium, and a gear pump which supplies the liquid to the discharge portion. The gear pump has a rotation shaft, a bearing portion which receives the rotation shaft, and a gear which is mounted on the rotation shaft and rotates with the rotation shaft, in such a manner that the gear feeds liquid. In addition, at least either a concave portion or a convex portion is provided in at least either the rotation shaft or the bearing portion. Furthermore, when the rotation shaft rotates, at least either the concave portion or the convex portion causes a dynamic pressure to be generated in liquid in a portion between the rotation shaft and the bearing portion, and thus the rotation shaft and the bearing portion move away from each other due to the dynamic pressure.

In the invention (in other words, the gear pump and the image recording apparatus) configured as described above, at least either the concave portion and the convex portion is provided in at least either the rotation shaft or the bearing portion. Furthermore, when the rotation shaft rotates, at least either the concave portion or the convex portion causes a dynamic pressure to be generated in the liquid in a portion between the rotation shaft and the bearing portion, and thus the rotation shaft and the bearing portion move away from each other due to the dynamic pressure. As a result, frictional heat generated between the rotation shaft and the bearing portion can be reduced.

In this case, at least either the concave portion or the convex portion may be provided in either the rotation shaft or the bearing portion.

The bearing portion may have a thrust bearing and at least a concave portion or a convex portion may be provided in either the rotation shaft or the thrust bearing. In this configuration, the bearing portion receives the rotation shaft, against a thrust load applied to the rotation shaft and, further, frictional heat generated between the rotation shaft and the bearing portion can be reduced.

The bearing portion may have a radial bearing and at least either a concave portion or a convex portion may be provided in either the rotation shaft or the radial bearing. In this configuration, the bearing portion receives the rotation shaft, against a radial load applied to the rotation shaft and, further, a frictional force generated between the rotation shaft and the bearing portion can be reduced.

The bearing portion may have a bearing main body and a separator which is provided in a portion between the bearing main body and the rotation shaft. Furthermore, at least either a concave portion or a convex portion may be provided in either the rotation shaft or the separator. In this configuration, at least either the concave portion or the convex portion is provided in either the rotation shaft or the separator. Accordingly, when the rotation shaft rotates, at least either the concave portion or the convex portion causes a dynamic pressure to be generated in the liquid in a portion between the rotation shaft and the separator, and thus the rotation shaft and the separator move away from each other due to the dynamic pressure. Since such a separator is provided in a portion between the bearing portion and the rotation shaft, frictional heat generated between the rotation shaft and the bearing portion can be reduced.

The liquid may be photo-curable ink. In a case where such liquid is used, when the liquid is heated, it is easy for foreign matter to be generated by a polymerization reaction of the liquid. Thus, it is particularly preferable that the invention is applied to such liquid.

There may be in the range of 2 ppm to 10 ppm of dissolved oxygen in the liquid passing through the gear pump. In this configuration, generation of foreign matter by a polymerization reaction can be relatively suppressed. Thus, when such liquid is used in the invention, foreign matter can be more effectively prevented from being generated.

To achieve the object described above, according to still another aspect of the invention, there is provided a gear pump which includes a rotation shaft, a bearing portion which receives the rotation shaft, and a gear which is mounted on the rotation shaft and rotates with the rotation shaft, in such a manner that the gear feeds liquid. Furthermore, at least either a concave portion or a convex portion is provided in at least either the rotation shaft or the bearing portion.

To achieve the object described above, according to still another aspect of the invention, there is provided an image recording apparatus which includes a discharge portion which discharges liquid onto a recording medium, and a gear pump which supplies the liquid to the discharge portion. Furthermore, the gear pump has a rotation shaft, a bearing portion which receives the rotation shaft, and a gear which is mounted on the rotation shaft and rotates with the rotation shaft, in such a manner that the gear feeds liquid. In addition, at least either a concave portion or a convex portion is provided in at least either the rotation shaft or the bearing portion.

In such a configuration, at least either the concave portion or the convex portion is provided in at least either the rotation shaft or the bearing portion. Accordingly, when the rotation shaft rotates, at least either the concave portion or the convex portion causes a dynamic pressure to be generated in the liquid in a portion between the rotation shaft and the bearing portion, and thus the rotation shaft and the bearing portion move away from each other due to the dynamic pressure. As a result, frictional heat generated between the rotation shaft and the bearing portion can be reduced.

BRIEF DESCRIPTION OF DRAWINGS

FIG. 1 is a schematic front view illustrating the configuration of a printer applied to the invention.

FIG. 2 is a schematic view illustrating an ink supply system and a recording head.

FIG. 3 is a cross-sectional view illustrating the specific configuration of a gear pump of the ink supply system illustrated in FIG. 2.

FIG. 4 is a partially enlarged view of the vicinity of a bearing portion.

FIG. 5A is a view illustrating a front-surface texture which can be formed in the surface of a separator.

FIG. 5B is a view illustrating a front-surface texture which can be formed in the surface of the separator.

FIG. 5C is a view illustrating a front-surface texture which can be formed in the surface of the separator.

DESCRIPTION OF EMBODIMENTS

FIG. 1 is a schematic front view illustrating the configuration of a printer applied to the invention. In a printer 1, one sheet S (in other words, a web) extends along a transport path Pc, in a state where both ends of the sheet S are wound, in a roll shape, around a feeding shaft 20 and a winding shaft 40, as illustrated in FIG. 1. The sheet S is subjected to image recording while the sheet S is transported in a transporting direction Ds which is directed from the feeding shaft 20 to the winding shaft 40. Types of the sheet S are roughly classified into a paper-based type and a film-based type. Specifically, examples of a paper-based type include a fine paper, a cast paper, an art paper, and a coated paper and examples of a film-based type include a synthetic paper, a polyethylene terephthalate (PET) film, and a polypropylene (PP) film. Schematically, the printer 1 includes a feeding section 2 (that is, a feeding area) in which the sheet S is fed from the feeding shaft 20, a processing section 3 (that is, a processing area) in which an image is recorded onto the sheet S fed from the feeding section 2, and a winding section 4 (that is, a winding area) in which the sheet S subjected to image recording in the processing section 3 is wound around the winding shaft 40. In the following description, one surface of the sheet S, on which an image is recorded, is referred to as a front surface and the other surface on a side opposite to the one surface is referred to as a back surface.

The feeding section 2 has a feeding shaft 20 around which the end of the sheet S is wound and a driven roller 21 around which the sheet S fed from the feeding shaft 20 is wound. The end of the sheet S is wound around and supported by the feeding shaft 20, in a state where the front surface of the sheet S is directed outside. When the feeding shaft 20 rotates in a clockwise direction in FIG. 1, the sheet S wound around the feeding shaft 20 passes through the driven roller 21, and then is fed to the processing section 3. Incidentally, the sheet S is wound around the feeding shaft 20 through a core tube 22 detachable from the feeding shaft 20. Accordingly, when the sheet S of the feeding shaft 20 is used up, a new core tube 22 around which a roll-shaped sheet S is wound is mounted on the feeding shaft 20, in such a manner that the sheet S of the feeding shaft 20 can be replaced.

In the processing section 3, the sheet S fed from the feeding section 2 is supported by a rotation drum 30 and processes are appropriately performed by respective functional units 51, 52, 61, 62, and 63 arranged along the outer circumferential surface of the rotation drum 30, in such a manner that an image is recorded onto the sheet S. In the processing section 3, a front driving roller 31 and a rear driving roller 32 are provided on both sides of the rotation drum 30 and the sheet S transported from the front driving roller 31 to the rear driving roller 32 is supported by the rotation drum 30, in such a manner that the sheet S is subjected to image recording.

In the front driving roller 31, a plurality of fine protrusions formed by thermal spraying are provided on the outer circumferential surface. The sheet S fed from the feeding section 2 is wound, from the back surface side, around the front driving roller 31. When the front driving roller 31 rotates in the clockwise direction of FIG. 1, the sheet S fed from the feeding section 2 is transported to a downstream side of the transport path. Furthermore, a nip roller 31*n* is provided facing the front driving roller 31. The nip roller 31*n* abuts on the front surface of the sheet S, in a state where the nip roller 31*n* is urged to the front driving roller 31 side. The sheet S is pinched in a portion between the front driving roller 31 and the nip roller 31*n*. Accordingly, frictional force is ensured between the front driving roller 31 and the sheet S, and thus it is possible to reliably perform transporting of the sheet S by the front driving roller 31.

The rotation drum 30 is a cylindrical-shaped drum which has a diameter of, for example, 400 [mm] and is supported by a supporting mechanism (not illustrated) such that the drum can rotate in the transporting direction Ds or the reverse direction. The sheet S transported from the front driving roller 31 to the rear driving roller 32 is wound, from the back surface side, around the rotation drum 30. The rotation drum 30 is rotationally driven, in the transporting direction Ds of the sheet S, by receiving the frictional force between the rotation drum 30 and the sheet S. The rotation drum 30 supports the sheet S from the back surface side. Incidentally, driven rollers 33 and 34 are provided in the processing section 3. The driven rollers 33 and 34 cause the sheet S to be bent on both sides of a winding portion with respect to the rotation drum 30. The driven roller 33 of the two driven rollers is disposed in a portion between the front driving roller 31 and the rotation drum 30 and causes the front surface of the sheet S to be wound therearound, in such a manner that the driven roller 33 bends the sheet S. Meanwhile, the driven roller 34 is disposed in a portion between the rotation drum 30 and the rear driving roller 32 and causes the front surface of the sheet S to be wound therearound, in such a manner that the driven roller 34 bends the sheet S. Accordingly, the sheet S is bent in both the upstream side and the downstream side of the rotation drum 30 in the transporting direction Ds, in such a manner that a long length of the winding portion of the sheet S, relating to the rotation drum 30, can be ensured.

In the rear driving roller 32, a plurality of fine protrusions formed by thermal spraying are provided on the outer circumferential surface. The sheet S transported from the rotation drum 30 via the driven roller 34 is wound, from the back surface side, around the rear driving roller 32. When the rear driving roller 32 rotates in the clockwise direction of FIG. 1, the sheet S is transported to the winding section 4. Furthermore, a nip roller 32*n* is provided facing the rear driving roller 32. The nip roller 32*n* abuts on the front surface of the sheet S, in a state where the nip roller 32*n* is urged to the rear driving roller 32 side. The sheet S is pinched in a portion between the rear driving roller 32 and the nip roller 32*n*. Accordingly, frictional force is ensured between the rear driving roller 32 and the sheet S, and thus it is possible to reliably perform transporting of the sheet S by the rear driving roller 32.

Therefore, the sheet S transported from the front driving roller 31 to the rear driving roller 32 is supported by the outer circumferential surface of the rotation drum 30. Furthermore, to record a color image onto the front surface of the sheet S supported by the rotation drum 30, a plurality of recording heads 51 corresponding to different colors are provided in the processing section 3. Specifically, four recording heads 51 corresponding to yellow, cyan, magenta, and black are aligned, in this order, along the transporting direction Ds. Each recording head 51 faces, with a slight clearance, the front surface of the sheet S wound around the rotation drum 30. The recording head 51 discharges an ink (a color ink) of a color corresponding thereto, through nozzles in an ink-jetting manner. Respective recording heads 51 discharge ink onto the sheet S transported in the transporting direction Ds, in such a manner that a color image is formed on the front surface of the sheet S.

Incidentally, an ultraviolet (UV)-curable ink (in other words, a photo-curable ink) is used as an ink. When the ink is irradiated with ultraviolet rays (light rays), a polymerization reaction occurs, and thus the ink is cured. To cure and fix the ink onto the sheet S, UV irradiation units 61 and 62 (in other words, irradiators) are provided in the processing section 3. Curing of ink is performed in two steps of pre-curing and main-curing. The UV irradiation unit 61 for pre-curing is disposed in a portion between the adjacent recording heads 51 of the plurality of recording heads 51. In other words, the UV irradiation unit 61 emits ultraviolet rays of which the irradiation intensity is weak, in such a manner that the UV irradiation unit 61 performs curing (pre-curing) of the ink to the extent that wet-spreading of the ink is sufficiently suppressed, compared to in the case where ultraviolet rays are not emitted onto the ink. The UV irradiation unit 61 does not perform main-curing of ink. Meanwhile, the UV irradiation unit 62 for main-curing is provided downstream in the transporting direction Ds, in relation to the plurality of the recording heads 51. In other words, the UV irradiation unit 62 emits ultraviolet rays of which the irradiation intensity is stronger than that of ultraviolet rays from the UV irradiation unit 61, in such a manner that the UV irradiation unit 62 performs curing (main-curing) of the ink to the extent that wet-spreading of the ink is prevented.

As described above, the UV irradiation unit 61 disposed in a portion between the adjacent recording heads 51 of the plurality of recording heads 51 performs pre-curing of the color ink which is discharged onto the sheet S from the recording head 51 in an area upstream from the UV irradiation unit 61 in the transporting direction Ds. Accordingly, the ink which is discharged from one recording head 51 onto the sheet S is subjected to pre-curing until the ink reaches, on the downstream side in the transporting direction Ds, the recording head 51 adjacent to the one recording head 51. As a result, color mixing, such as mixing of inks of different colors, is prevented from occurring. The plurality of recording heads 51 discharges inks of different colors, in a state where color mixing is prevented as described above, in such a manner that a color image is formed on the sheet S. Furthermore, the UV irradiation unit 62 is provided in an area downstream from the plurality of recording heads 51 in the transporting direction Ds. Accordingly, the color image formed by the plurality of recording heads 51 is subjected to main-curing and fixing by the UV irradiation unit 62.

Furthermore, a recording head 52 is provided in an area downstream from the UV irradiation unit 62 in the transporting direction Ds. The recording head 52 faces, with a slight clearance, the front surface of the sheet S wound around the rotation drum 30. The recording head 52 discharges transparent UV ink onto the front surface of the sheet S, through nozzles in an ink-jetting manner. In other words, transparent ink is discharged onto a color image formed by the recording heads 51 corresponding to four colors. The transparent ink is discharged over the entirety of a color image, in such a manner that a texture, such as the feel of gloss and the feel of matte, is imparted to the color image. In addition, a UV irradiation unit 63 (in other words, an irradiator) is provided in an area downstream from the recording head 52 in the transporting direction Ds. The UV irradiation unit 63 emits strong ultraviolet rays, in such a manner that the UV irradiation unit 63 performs main-curing of the transparent ink discharged from the recording head 52. Accordingly, the transparent ink can be fixed onto the front surface of the sheet S.

As described above, discharging and curing of ink is appropriately performed, in the processing section 3, with respect to the sheet S wound around the outer circumferential portion of the rotation drum 30. As a result, a color image coated with the transparent ink is formed. Then, the sheet S on which the color image is formed is transported to the winding section 4 by the rear driving roller 32.

The winding section 4 has, in addition to the winding shaft 40 around which the end of the sheet S is wound, a driven roller 41. The driven roller 41 is disposed in a portion between the winding shaft 40 and the rear driving roller 32. The sheet S is wound, from the back surface side, around the driven roller 41. The end of the sheet S is wound around and supported by the winding shaft 40, in a state where the front surface of the sheet S is directed outside. In other words, when the winding shaft 40 rotates in the clockwise direction of FIG. 1, the sheet S transported from the rear driving roller 32 passes through the driven roller 41 and is wound around the winding shaft 40. Incidentally, the sheet S is wound around the winding shaft 40 through a core tube 42 detachable from the winding shaft 40. Accordingly, when the sheet S is fully wound around the winding shaft 40, the sheet S can be removed with the core tube 42.

The overview of the configuration of the printer 1 is described above. Next, details of an ink supply system 7 provided in the printer 1 will be described. FIG. 2 is a schematic view illustrating the ink supply system and the recording head. The ink supply system 7 includes a plurality (corresponding to the number of colors) of ink-flow control mechanisms 71. However, the ink-flow control mechanisms 71 have the same configuration, and thus only one ink-flow control mechanism 71 is schematically illustrated in FIG. 2. Furthermore, the recording heads 51 and 52 corresponding to each color have the same configuration, and thus only one recording head 51 is schematically illustrated in FIG. 2. Only the configuration of a part of the recording head 51, which is a portion in the vicinity of a nozzle forming surface NS, is illustrated in FIG. 2.

The recording head 51 has nozzles N, a reservoir RS, and a cavity CV. The nozzles N open in the nozzle forming surface NS. The reservoir RS temporarily stores ink. The cavity CV allows the nozzles N to communicate with the reservoir RS. The ink is supplied from the reservoir RS to the nozzles N via the cavity CV. The cavity CV applies pressure to ink, in such a manner that the ink is discharged from the nozzles N.

Meanwhile, the ink-flow control mechanism 71 provided in the ink supply system 7 circulates ink in a portion between a tank 710 (in other words, a sub-tank) storing ink and the recording head 51. Specifically, the ink-flow control mechanism 71 has, in addition to the tank 710, a supply flow path 711 (which is a supply piping portion), a gear pump 8, and a recovery flow path 713 (which is a recovery piping portion). The supply flow path 711 connects the reservoir RS and the tank 710. The gear pump 8 is provided in the supply flow path 711. The recovery flow path 713 connects the reservoir RS and the tank 710. Accordingly, a circulation path 71C is formed. In the circulation path 71C, the ink flows, in order, through the tank 710, the supply flow path 711, the recovery flow path 713, and the tank 710. The gear pump 8 rotates in a forward direction, in such a manner that the ink circulates in the circulation path 71C. In other words, when the gear pump 8 rotates in the forward direction, the ink can be supplied from the tank 710 to the reservoir RS through the supply flow path 711 (which is an outward path) and, further, the ink can be recovered from the reservoir RS to the tank 710 through the recovery flow path 713 (which is a return path).

Furthermore, the ink-flow control mechanism 71 has a valve 714 which opens/closes the supply flow path 711. The valve 714 is provided in the middle of a part of the circulation path 71C, which is a portion extending from the gear pump 8 to the reservoir RS. Accordingly, when the valve 714 is opened, supplying of ink is performed from the tank 710 to the reservoir RS and, further, when the valve 714 is closed, supplying of ink is stopped from the tank 710 to the reservoir RS.

In addition, the ink-flow control mechanism 71 has an ink supply path 715 (which is an ink supply piping portion) and a pressure adjustment flow path 716 (which is a pressure adjustment piping portion). The ink is supplied to the tank 710 through the ink supply path 715. The pressure adjustment flow path 716 adjusts the pressure in the tank 710. The ink supply path 715 is connected to an ink pack and ink is supplied from the ink pack to the tank 710 through the ink supply path 715. Incidentally, the ink supplied to the tank 710 is an UV ink of which the viscosity is 15 [millipascal-seconds] at the temperature of, for example, 28 degrees Celsius to 40 degrees Celsius. Furthermore, the pressure adjustment flow path 716 is connected to a pump and the pressure in the tank 710 is adjusted by rotating the pump. Accordingly, the pressure in the tank 710 can be adjusted to a negative pressure, the atmosphere pressure, or a positive pressure.

FIG. 3 is a schematic and partial cross-sectional view illustrating the specific configuration of the gear pump of the ink supply system illustrated in FIG. 2. An XYZ orthogonal coordinate system is used in FIG. 3. In the XYZ orthogonal coordinate system, the Z direction is an ink flowing direction when the gear pump 8 rotates in the forward direction. The gear pump 8 has a case 80 in which two accommodation chambers A and B are aligned in the Y direction.

A motor 810, a holding member 811, and an outer magnet 812 are provided in the outside of the case 80 in the Y direction. The holding member 811 is mounted on an output shaft of the motor 810. The outer magnet 812 is held by the holding member 811. When rotational driving force is applied from the motor 810 to the holding member 811, the holding member 811 and the outer magnet 812 rotate about a rotation center line Y1 parallel to the Y direction. The outer magnet 812 faces, in the X direction, the accommodation chamber A with the case 80 interposed therebetween. When the holding member 811 rotates, the outer magnet 812 rotates around the accommodation chamber A, with the rotation center line Y1 as a center.

An inner magnet 813 and a holding member 814 which holds the inner magnet 813 are provided in the accommodation chamber A. The holding member 814 can rotate about the rotation center line Y1, in a state where the holding member 814 holds the inner magnet 813. The inner magnet 813 faces, in the X direction, the outer magnet 812 with the case 80 interposed therebetween. When the outer magnet 812 rotates, the inner magnet 813 follows the rotation due to the magnetic force between the outer magnet 812 and the inner magnet 813. Accordingly, when the outer magnet 812 rotates, both the inner magnet 813 and the holding member 814 integrally rotate about the rotation center line Y1. In the gear pump 8, a driving mechanism 81 is constituted by the motor 810, the holding member 811, the outer magnet 812, the inner magnet 813, and the holding member 814, as described above.

Both ends of the accommodation chamber B in the Z direction are connected to the circulation path 71C (see FIG. 2). The accommodation chamber B is filled with the ink supplied from the tank 710 (see FIG. 2). A driving gear 83 and a driven gear 84 are provided in the accommodation chamber B, in a state where the driving gear 83 and the driven gear 84 face each other in the X direction. The driving gear 83 and the driven gear 84 are a pair of helical gears meshing with each other. The driving gear 83 and the driven gear 84 can be constituted of, for example, non-metallic material (such as resins, ceramics, and rubbers).

The driving gear 83 is mounted on a driving rotation-shaft 85 which passes through, in the rotation center line Y1, the accommodation chamber B. The driving rotation-shaft 85 extends to the accommodation chamber A. In the accommodation chamber A, the driving rotation-shaft 85 is connected to the holding member 814 through a linking member 815. Accordingly, when the holding member 814 rotates, the driving gear 83 and the driving rotation-shaft 85 integrally rotate about the rotation center line Y1. The driven gear 84 is mounted on a driven rotation-shaft 86 which passes through, in a rotation center line Y2 parallel to the Y direction, the accommodation chamber B. When the driving gear 83 rotates, the driven gear 84 and the driven rotation-shaft 86 integrally rotate about the rotation center line Y2.

Furthermore, a pair of bearing portions 87 and 87 aligned in the rotation center line Y1 is provided in the case 80. The bearing portions 87 and 87 receive different end portions of the driving rotation-shaft 85. Accordingly, the driving rotation-shaft 85 is rotationally supported by the bearing portions 87 and 87. Incidentally, one end portion of the driving rotation-shaft 85 extends to the accommodation chamber A, and thus the bearing portions 87 and 87 receiving the one end portion of the driving rotation-shaft 85 is provided in the accommodation chamber A. In addition, a pair of bearing portions 88 and 88 aligned in the rotation center line Y2 is provided in the case 80. The bearing portions 88 and 88 receive different end portions of the driven rotation-shaft 86. Accordingly, the driven rotation-shaft 86 is rotationally supported by the bearing portions 88 and 88.

In the gear pump 8 having the configuration described above, the driving gear 83 rotates by receiving the driving force from the motor 810 and, further, the driven gear 84 and the driven rotation-shaft 86 integrally rotate following the driving gear 83. As a result, the ink in the accommodation chamber B flows to the downstream side of the circulation path 71C (see FIG. 2) in an ink circulating direction and, further, the ink flows, into the accommodation chamber B, from the upstream side of the circulation path 71C in the ink circulating direction. Therefore, the ink can be circulated by the gear pump 8.

Meanwhile, the ink in the accommodation chamber B enters the bearing portion 87 through a gap between the driving rotation-shaft 85 (or the linking member 815) and the inner wall of the case 80. Similarly, the ink in the accommodation chamber B enters the bearing portion 88 through a gap between the driven rotation-shaft 86 and the inner wall of the case 80. There is a concern that, when the ink having entered the bearing portions 87 and 88 is heated by frictional heat generated between the driving rotation-shafts 85 and 86 and the bearing portions 87 and 88, the ink may be cured. Particularly, when there is little dissolved oxygen in the ink, the ink is likely to be cured at a relatively low temperature. In other words, when there is much dissolved oxygen in the ink, ink discharge stability decreases. In contrast, when there is extremely little dissolved oxygen in the ink, foreign matter is generated, in the ink, by a polymerization reaction. Accordingly, it is preferable that a range of 2 ppm to 10 ppm of dissolved oxygen is maintained in the ink in the circulation path 71C. Here, the gear pump 8 according to this embodiment has a configuration capable of reducing the frictional heat between the driving rotation-shafts 85 and 86 and the bearing portions 87 and 88. This will be described with reference to FIG. 4.

FIG. 4 is a partially enlarged view of the vicinity of the bearing portion. The bearing portions 87 and 88 have the same configuration, and thus only the configuration of the bearing portion 87 is illustrated in FIG. 4. The bearing portion 87 has a separator 870 and a bearing main body 871. The separator 870 has a disk shape. The bearing main body 871 has a bearing hole 872 which has a substantially cylindrical shape and is open, in the Y direction, toward the driving rotation-shaft 85. The separator 870 is disposed in a bottom surface 873 of the bearing hole 872.

The end portion of the driving rotation-shaft 85 in the Y direction is inserted into the bearing hole 872 through the opening. Accordingly, an end surface 851 of the driving rotation-shaft 85 faces, in the Y direction, a surface 870*a* of the separator 870. Furthermore, a circumferential surface 852 of the end portion of the driving rotation-shaft 85 faces, in the X direction, a side surface 874 of the inner wall of the bearing main body 871. The separator 870 functions as a thrust bearing for receiving thrust load applied to the driving rotation-shaft 85. The side surface 874 of the bearing portion 87 functions as a radial bearing for receiving radial load applied to the driving rotation-shaft 85.

A front-surface texture TXa (see FIGS. 5A to 5C) which is constituted of at least either a concave portion or a convex portion is formed in the surface 870*a* (in other words, a portion facing the end surface 851 of the driving rotation-shaft 85) of the separator 870. Various patterns can be used as the pattern of the front-surface texture TXa. For example, one of the patterns illustrated in FIGS. 5A to 5C can be used as the pattern of the front-surface texture TXa. Here, FIGS. 5A to 5C are views illustrating front-surface textures which can be formed in the surface of the separator. The pattern constituted of a plurality of dots is illustrated in FIG. 5A and the pattern constituted of a plurality of lines extending radially is illustrated in FIG. 5B. In addition, the pattern in which a plurality of V shapes are arranged in a ring shape is illustrated in FIG. 5C. Furthermore, a front-surface texture TXb which is constituted of at least either a concave portion or a convex portion is formed in the circumferential surface 852 of the end portion of the driving rotation-shaft 85. The front-surface texture TXb is formed over the circumference of the circumferential surface 852.

In the configuration described above, when the driving rotation-shaft 85 rotates, the front-surface texture TXa causes a dynamic pressure to be generated in ink in the portion between the driving rotation-shaft 85 and the separator 870. Thus, the driving rotation-shaft 85 and the separator 870 are separated, in the Y direction, by the dynamic pressure. Furthermore, when the driving rotation-shaft 85 rotates, the front-surface texture TXb causes a dynamic pressure to be generated in ink in the portion between the circumferential surface 852 of the driving rotation-shaft 85 and the side surface 874 of the bearing portion 87. Thus, the circumferential surface 852 of the driving rotation-shaft 85 and the side surface 874 of the bearing portion 87 are separated, in the X direction, by the dynamic pressure. As a result, the frictional heat generated between the driving rotation-shaft 85 and the bearing portion 87 can be reduced.

Furthermore, the bearing portion 87 has a separator 870 functioning as a thrust bearing. Accordingly, the bearing portion 87 can receive the driving rotation-shaft 85, against the thrust load applied to the driving rotation-shaft 85 and, further, the frictional heat generated between the driving rotation-shaft 85 and the bearing portion 87 can be reduced.

Furthermore, the bearing portion 87 has a side surface 874 functioning as a radial bearing. Accordingly, the bearing portion 87 can receive the driving rotation-shaft 85, against the radial load applied to the driving rotation-shaft 85 and, further, the frictional force generated between the driving rotation-shaft 85 and the bearing portion 87 can be reduced.

The driven rotation-shaft 86 and the bearing portion 88 also have the same configurations as those illustrated in FIG. 4. Accordingly, the frictional heat generated between the driven rotation-shaft 86 and the bearing portion 88 can be reduced, similarly to in the case of the driving rotation-shaft 85 and the bearing portion 87.

As described above, in this embodiment, the printer 1 corresponds to an example of an "image recording apparatus" of the invention and the recording heads 51 and 52 correspond to examples of a "discharge portion" of the invention. Furthermore, the gear pump 8 corresponds to an example of a "gear pump" of the invention and the driving rotation-shaft 85 and the driven rotation-shaft 86 correspond to examples of a "rotation shaft" of the invention. The bearing portion 87 and the bearing portion 88 correspond to examples of a "bearing portion" of the invention and the driving gear 83 and the driven gear 84 correspond to examples of a "gear" of the invention. In addition, the front-surface texture TXa or the front-surface texture TXb corresponds to an example of at least either "the concave portion or the convex portion" of the invention. The ink corresponds to an example of "liquid" of the invention.

The invention is not intended to be limited by the embodiment described above. The embodiment of the invention can be modified in various ways as long as it does not depart from the spirit of the invention. For example, the case in which the gear pump 8 according to the invention is applied as an application for feeding ink in the printer 1 is described in the embodiment described above. However, the gear pump 8 according to the invention can also be applied as other applications.

In the embodiment described above, the front-surface texture TXa is formed in the separator 870 of the bearing portion 87. However, the front-surface texture TXa may be formed in the bottom surface 873 of the bearing portion 87 without the separator 870.

Alternatively, the front-surface texture TXa may be formed in the end surface 851 of the driving rotation-shaft 85. In this case, the front-surface texture TXa is not formed in the surface 870*a* of the separator 870 or the separator 870 is not provided. In other words, the front-surface texture TXa is formed in at least either the separator 870 or the bottom surface 873 of the bearing portion 87 or the end surface 851 of the driving rotation-shaft 85. It is more preferable that the front-surface texture TXa is formed in either the separator 870 or the bottom surface 873 of the bearing portion 87 or the end surface 851 of the driving rotation-shaft 85. In the configuration described above, when the driving rotation-shaft 85 rotates, the front-surface texture TXa causes a dynamic pressure to be generated in the ink in the portion between the driving rotation-shaft 85 and the separator 870 or the bottom surface 873 of the bearing portion 87. Thus, the driving rotation-shaft 85 and the bearing portion 87 are separated, in the Y direction, by the dynamic pressure. As a result, the frictional heat generated between the driving rotation-shaft 85 and the bearing portion 87 can be reduced.

In the embodiment described above, the front-surface texture TXb is formed in the circumferential surface 852 of the driving rotation-shaft 85. However, the front-surface texture TXb may be provided in the side surface 874 (in other words, a portion facing the end portion of the driving rotation-shaft 85) of the bearing portion 87 and the front-surface texture TXb may not be formed in the circumferential surface 852 of the driving rotation-shaft 85. In other words, the front-surface texture TXb is formed in at least either the circumferential surface 852 of the driving rotation-shaft 85 or the side surface 874 of the bearing portion 87. It is more preferable that the front-surface texture TXb is formed in either the circumferential surface 852 of the driving rotation-shaft 85 or the side surface 874 of the bearing portion 87. In the configuration described above, when the driving rotation-shaft 85 rotates, the front-surface texture TXb causes a dynamic pressure to be generated in the ink in the portion between the driving rotation-shaft 85 and the bearing portion 87. Thus, the driving rotation-shaft 85 and the bearing portion 87 are separated, in the X direction, by the dynamic pressure. As a result, the frictional heat generated between the driving rotation-shaft 85 and the bearing portion 87 can be reduced.

Furthermore, a member for supporting the transported sheet S is not limited to a cylindrical-shaped member, such as the rotation drum 30 described above. Accordingly, a flat-type platen in which the sheet S is supported by a flat surface can be used as a member for supporting the transported sheet S.

The entire disclosure of Japanese Patent Application No. 2014-033668, filed Feb. 25, 2014 is expressly incorporated by reference herein.

REFERENCE SIGNS LIST

1 Printer
51, 52 Recording head
8 Gear pump
83 Driving gear
84 Driven gear
85 Driving rotation-shaft
86 Driven rotation-shaft
87, 88 Bearing portion
TXa, TXb Front-surface texture

The invention claimed is:

1. A gear pump comprising:
a rotation shaft;
a bearing portion which defines a recess that receives a terminal portion of the rotation shaft, the bearing portion also including a separator disposed in the recess so as to be positioned between the terminal portion of the shaft and a bottom of the recess; and
a gear which is mounted on the rotation shaft and rotates with the rotation shaft, in such a manner that the gear feeds liquid,
wherein a surface pattern comprising at least either a concave portion or a convex portion is provided in the separator of the bearing portion, and
wherein, when the rotation shaft rotates, at least either the concave portion or the convex portion causes a dynamic pressure to be generated in liquid in a portion between the rotation shaft and the bearing portion, and thus the rotation shaft and the bearing portion move away from each other due to the dynamic pressure.

2. The gear pump according to claim 1,
wherein the surface pattern is also provided in the rotation shaft.

3. The gear pump according to claim 1 or 2,
wherein the bearing portion has a thrust bearing, and
wherein at least a concave portion or a convex portion is provided in either the rotation shaft or the thrust bearing.

4. The gear pump according to any one of claim 1 or 2,
wherein the bearing portion has a radial bearing, and
wherein at least either a concave portion or a convex portion is provided in either the rotation shaft or the radial bearing.

5. The gear pump according to any one of claim 1 or 2, wherein the bearing portion has a bearing main body and a separator which is provided in a portion between the bearing main body and the rotation shaft, and wherein at least either a concave portion or a convex portion is provided in either the rotation shaft or the separator.

6. The gear pump according to claim 1, wherein the surface pattern comprises a texture.

7. The gear pump according to claim 1, wherein the surface pattern extends around a circumference of the rotation shaft and/or around an inside diameter of the bearing portion.

8. A gear pump comprising:

a rotation shaft;

a bearing portion which defines a recess that receives a terminal portion of the rotation shaft, the bearing portion also including a separator disposed in the recess so as to be positioned between the terminal portion of the shaft and a bottom of the recess; and a gear which is mounted on the rotation shaft and rotates with the rotation shaft, in such a manner that the gear feeds liquid, wherein a surface pattern comprising at least either a concave portion or a convex portion is provided in the separator of the bearing portion.

9. The gear pump according to claim 8, wherein the surface pattern comprises a texture.

10. The gear pump according to claim 8, wherein the surface pattern extends around a circumference of the rotation shaft and/or around an inside diameter of the bearing portion.

11. An image recording apparatus comprising:

a discharge portion which discharges liquid onto a recording medium; and a gear pump which supplies the liquid to the discharge portion, wherein the gear pump has a rotation shaft, a bearing portion which defines a recess that receives a terminal portion of the rotation shaft, the bearing portion also including a separator disposed in the recess so as to be positioned between the terminal portion of the shaft and a bottom of the recess, and a gear which is mounted on the rotation shaft and rotates with the rotation shaft, in such a manner that the gear feeds liquid, wherein a surface pattern comprising at least either a concave portion or a convex portion is provided in the separator of the bearing portion, and wherein, when the rotation shaft rotates, at least either the concave portion or the convex portion causes a dynamic pressure to be generated in liquid in a portion between the rotation shaft and the bearing portion, and thus the rotation shaft and the bearing portion move away from each other due to the dynamic pressure.

12. The image recording apparatus according to claim 11, wherein the surface pattern is also provided in the rotation shaft.

13. The image recording apparatus according to claim 11 or 12, wherein the liquid is photo-curable ink.

14. The image recording apparatus according to claim 13, wherein there is a range of 2 ppm to 10 ppm of dissolved oxygen in the liquid passing through the gear pump.

15. The image recording apparatus according to claim 11, wherein the surface pattern comprises a texture.

16. The image recording apparatus according to claim 11, wherein the surface pattern extends around a circumference of the rotation shaft and/or around an inside diameter of the bearing portion.

* * * * *